US006580397B2

(12) United States Patent
Lindell

(10) Patent No.: US 6,580,397 B2
(45) Date of Patent: Jun. 17, 2003

(54) ARRANGEMENT FOR A MOBILE TERMINAL

(75) Inventor: Bo Lindell, Lidingö (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 09/983,861

(22) Filed: Oct. 26, 2001

(65) Prior Publication Data

US 2002/0053991 A1 May 9, 2002

(30) Foreign Application Priority Data

Oct. 27, 2000 (SE) ..... 0003951

(51) Int. Cl.[7] ..... H01Q 1/24
(52) U.S. Cl. ..... 343/702
(58) Field of Search ..... 343/700 MS, 702, 343/846, 848, 850, 860; 455/89, 90

(56) References Cited

U.S. PATENT DOCUMENTS

| | | | | |
|---|---|---|---|---|
| 4,471,493 A | | 9/1984 | Schober | |
| 4,491,843 A | | 1/1985 | Boubouleix | |
| 5,598,174 A | * | 1/1997 | Erkocevic et al. | 343/702 |
| 5,781,159 A | * | 7/1998 | Desargant | 343/700 MS |
| 5,914,696 A | * | 6/1999 | Vanderhelm et al. | 343/702 |
| 5,995,052 A | | 11/1999 | Sadler et al. | |
| 6,107,967 A | * | 8/2000 | Hill | 343/700 MS |
| 6,135,445 A | * | 10/2000 | Gamperling et al. | 271/220 |
| 6,239,755 B1 | * | 5/2001 | Klemens et al. | 343/702 |
| 6,323,812 B1 | * | 11/2001 | Perrotta et al. | 343/702 |
| 6,342,859 B1 | * | 1/2002 | Kurz et al. | 343/700 MS |
| 6,421,016 B1 | * | 7/2002 | Phillips et al. | 343/702 |

FOREIGN PATENT DOCUMENTS

| | | |
|---|---|---|
| DE | 4300705 A1 | 7/1993 |
| EP | 0341881 A2 | 11/1989 |
| WO | WO99/43039 | 8/1999 |
| WO | WO00/35048 | 6/2000 |

OTHER PUBLICATIONS

Hubert Trzaska: "Counterpoise in Mobile Radiotelephony", Asia–Pacific Conference on Environmental Electromagnetics CEEM'2000, May 3–7, 2000, Shanghai, China. pp. 72–75.

Balanis: "Antenna theory analysis and design", pp. 566–571, John Wiley & Sons.

"The Radio Amateur's Handbook 1967", by ARRL, p. 369.

* cited by examiner

*Primary Examiner*—Tan Ho
(74) *Attorney, Agent, or Firm*—Burns, Doane, Swecker & Mathis, L.L.P.

(57) ABSTRACT

The invention relates to an antenna system for a mobile terminal (1), comprising a casing (2), which accommodates radio electronic circuits (REC) and a screening device (SD) for the radio electronic circuits. The antenna system comprises an end-fed antenna (4), having an extended shape and being connected to the radio electronic circuits (REC). The antenna system comprises a counterpoise element (5), located near one end of the end-fed antenna (4), and the end-fed antenna is adapted to be fed, during transmission, against the counterpoise element (5) by the radio electronic circuits (REC).

16 Claims, 8 Drawing Sheets

ARRANGEMENT FOR A MOBILE TERMINAL

TECHNICAL FIELD OF THE INVENTION

The present invention refers to an antenna system for a mobile terminal, according to the preamble of claim 1.

DESCRIPTION OF RELATED ART

In mobile terminal technology, there has been, and continues to be, a trend towards decreasing the size of the terminals themselves. There is also a requirement for the antenna system to be equipped to use two or more widely separated frequency bands.

Combined antennas, with multiple resonances at the desired frequencies, are known to persons skilled in the art. External antennas are usually designed as removable mechanical units, resonant in two frequency bands. Built in antennas for the cellular phone bands are often of PIFA (Planar Inverted F Antenna) or patch type. External antennas and built-in antennas of the types mentioned use matching of 50 ohms included in the antenna element structure. A disadvantage with these antennas, is that they are not optimal in size for employing two or more resonances at frequencies used for communication between mobile terminals and base stations.

U.S. Pat. No. 4,491,843 describes an antenna for a portable receiver, comprising a metal plate and a metal box or case, whereby the antenna forms an electric dipole, comprising the metal plate and another "virtual" metal plate, located half-way up the box. A disadvantage with the design in U.S. Pat. No. 4,491,843 is that the electric dipole formed is small compared to the wavelength. The effect of this is that the size of the band-width that is possible to obtain is very limited. Another disadvantage is that in order for the design in U.S. Pat. No. 4,491,843 to function as a electric dipole, a number of geometric requirements has to be fulfilled, e.g. the size and shape of the metal box and metal plate, and the distance between them. This limits the possibilities for variations in the arrangement and design of the mobile terminal.

SUMMARY

It is an object of the present invention to provide an antenna system for a mobile terminal, which facilitates the design of small terminals and is more effective and more cost effective than present antenna systems.

The object is met by an antenna system, having the characterizing features of claim 1.

Using an end-fed antenna located within the casing of the terminal, and having a counterpoise element, located near one end of the end-fed antenna, results in less restrictions in the designing of the mobile terminal, since the counterpoise element, in order to meet antenna requirements, can assume a wide range of shapes and sizes. This means that the invention opens new possibilities for the creation of different industrial designs.

Preferably, the end-fed antenna extends through a major part of the mobile terminal casing, and is formed by the terminal chassis or-the screening device for the radio electronic circuits. Alternatively, the casing itself forms an antenna. Whether the chassis, screening or casing is used, the effect is that essentially the full mechanical length of the terminal, i.e. as much as possible of the available space is used for the antenna. This has the result of presenting a larger antenna than in known terminals, which provides for a larger bandwidth. The fact that the bandwidth of a small antenna is limited by its size is explained by Balanis, "Antenna theory analysis and design", pages 566–571, John Wiley & Sons.

Preferably, the electrical length of the end-fed antenna is in the vicinity of a full or a half wavelength of a frequency, on which the end-fed antenna is intended to transmit or receive. The electrical length of an antenna is often slightly larger than the physical length of the latter, as explained, for example in "The Radio Amateur's Handbook 1967" by ARRL, page 369. Providing a full or a half wavelength antenna makes it possible to use a counterpoise with a lower self-capacitance, than what would have been the case for a quarter wavelength antenna. This means that the counterpoise can be small in size.

Further features, developments and advantages with the present invention are obtained in connection to the dependent claims, and are revealed in the description here below.

BRIEF DESCRIPTION OF THE DRAWINGS

The invention will now be described in greater detail, with the aid of the accompanying drawings, on which

DETAILED DESCRIPTION OF EMBODIMENTS

Figure 1:
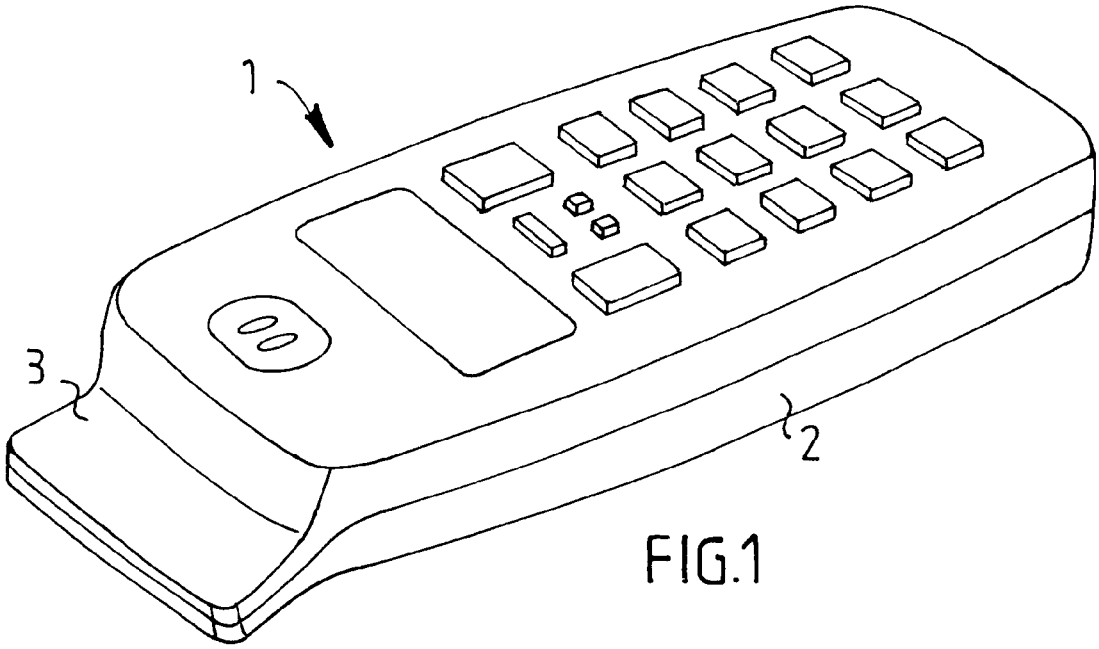
FIG. 1 shows a schematic perspective view of a mobile terminal, equipped with an antenna system according to a first embodiment of the present invention.

FIG. 1 shows a mobile terminal 1, equipped with an antenna arrangement according to a first embodiment of the present invention. As stated above, it is one of the advantages of the present invention, that it makes it possible to achieve a wide array of different industrial designs, having individual appearances in relation to each other. Thus, the appearance of the mobile terminal 1 in FIG. 1 is exemplifying only. The mobile terminal 1 comprises a main casing 2, having an extended shape. A counterpoise housing 3 is located at one end of the main casing 2.

Figure 2:
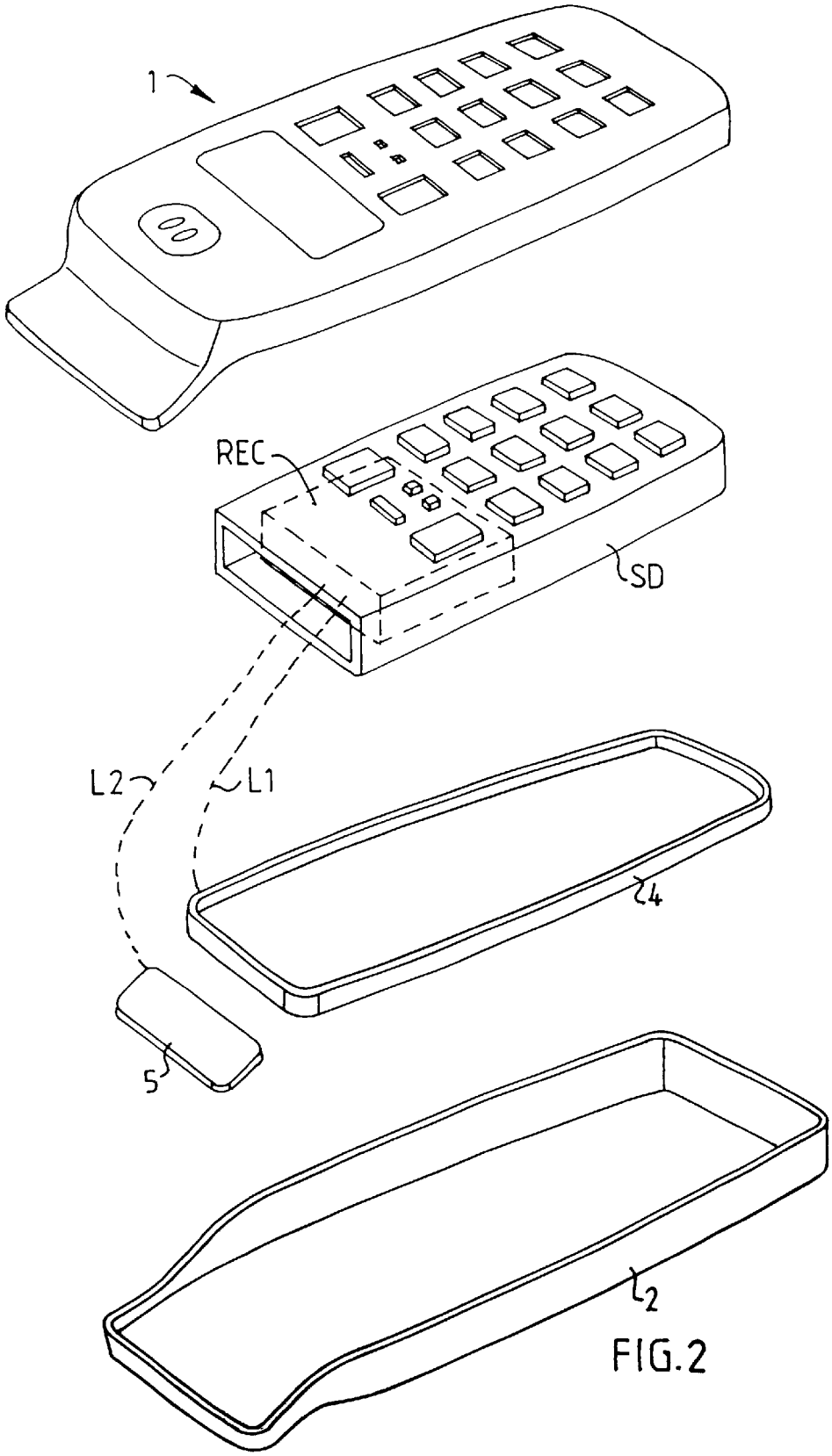
FIG. 2 shows a schematic exploded view of the mobile terminal from FIG. 1.

FIG. 2 shows an exploded view of the first embodiment of the mobile terminal 1. A terminal chassis 4, having an extended shape, is located within the main casing 2. The terminal chassis 4 carries the internal components of the mobile terminal 1, and serves as a structural frame for the latter, as is known to persons skilled in the art.

The mobile terminal comprises a screened compartment, or screening device SD, having a box-like shape. The screening device SD encloses radio electronic circuits REC, indicated with broken lines in FIG. 2. The screening device serves SD to protect the radio electronic circuits REC from external electromagnetic radiation, and also prevents external electromagnetic radiation from the radio electronic circuits REC to escape to the surrounding environment, as is known to persons skilled in the art.

An end-fed antenna is also provided within the casing 20 According to the first embodiment of the invention, the terminal chassis 4 is also used as the end-fed antenna 4. Preferably the chassis 4 is adapted so as to have an electrical length corresponding approximately to the wavelength of the frequency, or frequencies, on which the antenna is intended to transmit or receive. Consequently, the electrical length of the chassis 4 in FIG. 2 approximately corresponds to half a wavelength at 900 MHz and a full wavelength at 1800 MHz, which are frequencies commonly used in mobile telephone communications. The relatively small length to width ratio of the chassis 4 makes it usable for a wide band antenna.

According to the invention, a counterpoise element 5 for the end-fed antenna 4 is located at one end of it, the end-fed antenna 4 being constituted by the terminal chassis 4 in the embodiment shown in FIG. 2. Preferably the counterpoise element 5 consists of a metal plate, located at a small distance from the chassis 4. The counterpoise can be held in place in the mobile terminal 1 by means of a holder, not shown, secured on the chassis 4, the holder being made of an insulating material.

Alternatively the counterpoise 5 can be secured against the screening compartment, or other suitable component of the mobile terminal 1, whereby the fastening means for the counterpoise element 5 is made out of a non-conductive material.

I FIG. 2 the counterpoise 5 is shown as an essentially flat metal plate with an extended shape, being oriented transversely of the end-fed antenna 4. In FIG. 2 the metal plate is leaned in a direction towards the backside of the mobile terminal 1. As an alternative the metal plate could lean towards the front side of the mobile terminal 1. It could also be aligned with the end-fed antenna 4. Furthermore the counterpoise 5 could be an extended metal plate having a curved cross section. It could also have the shape of a cylinder, having its axis transversely of the end-fed antenna 4.

The radio electronic circuits REC are connected between the chassis 4 and the counterpoise 5, as illustrated by the broken lines L1 and L2, respectively. During transmission, the radio electronic circuits REC functions as a transmitter, feeding the antenna system between the chassis 4 and the counterpoise 5. When receiving, the radio electronic circuits REC works as a receiver, receiving a signal from the antenna system. The counterpoise element 5 serves as a low loss drain for the antenna current, or an artificial ground for the antenna system, and does not contribute itself, in any essential degree, to the radiated field, during transmission.

Figure 3:
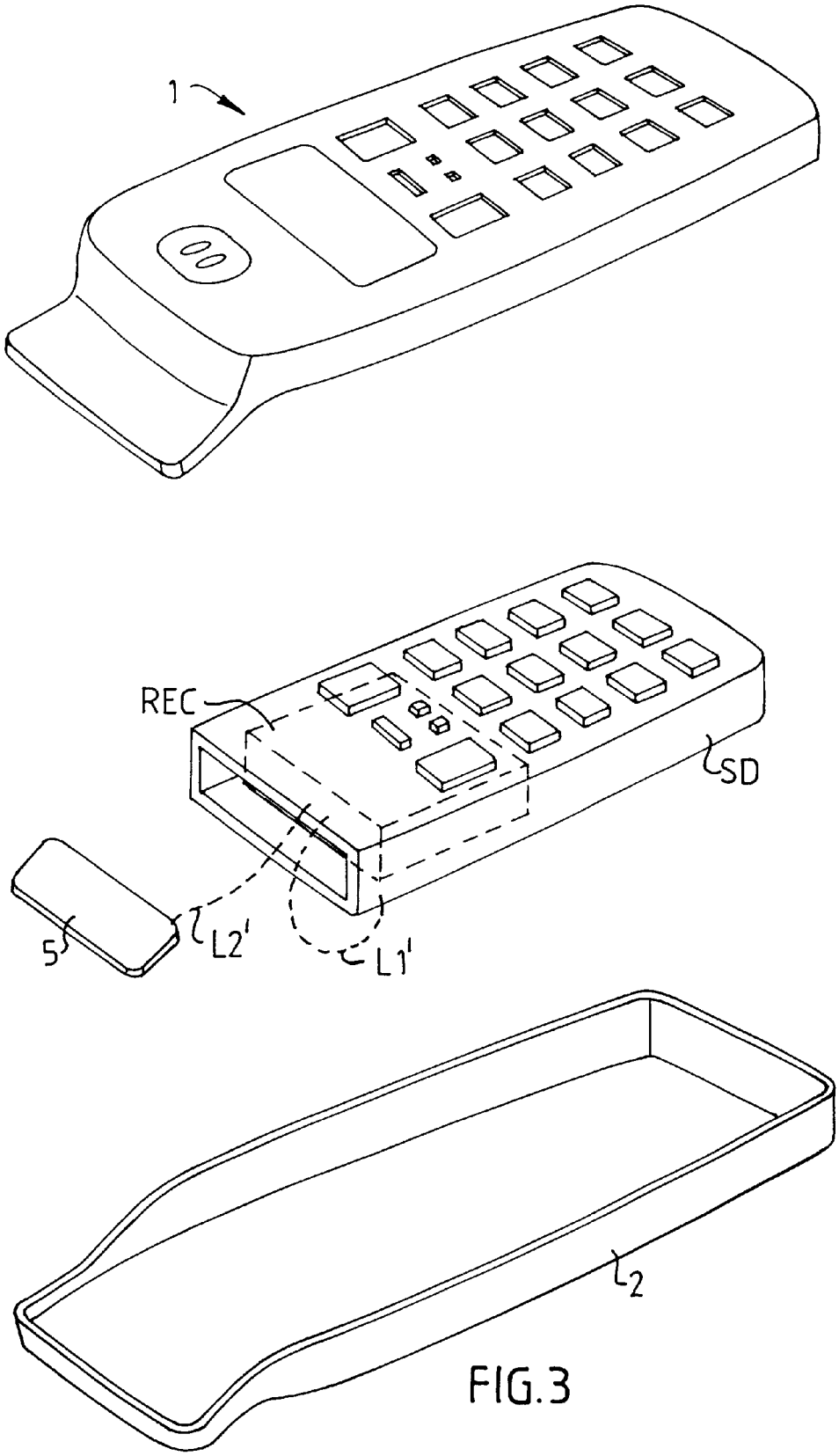
FIG. 3 shows a schematic exploded view of a mobile terminal, equipped with an antenna system according to a second embodiment of the present invention.

FIG. 3 shows a second embodiment of the present invention. Here the screening device SD as described with reference to FIG. 2, above, serves as the end-fed antenna. In this embodiment the chassis could constitute a separate part, or, as an alternative, the screening device SD could also serve as a chassis for the mobile terminal 1. In the latter case the mobile terminal 1 is provided with a body, having multiple tasks of a structural chassis, a screening device, and an end-fed antenna. In FIG. 3, the connection from the radio electronic circuits REC to the screening device SD and the counterpoise 5 is represented by the broken lines L1' and L2', respectively.

Figure 4:
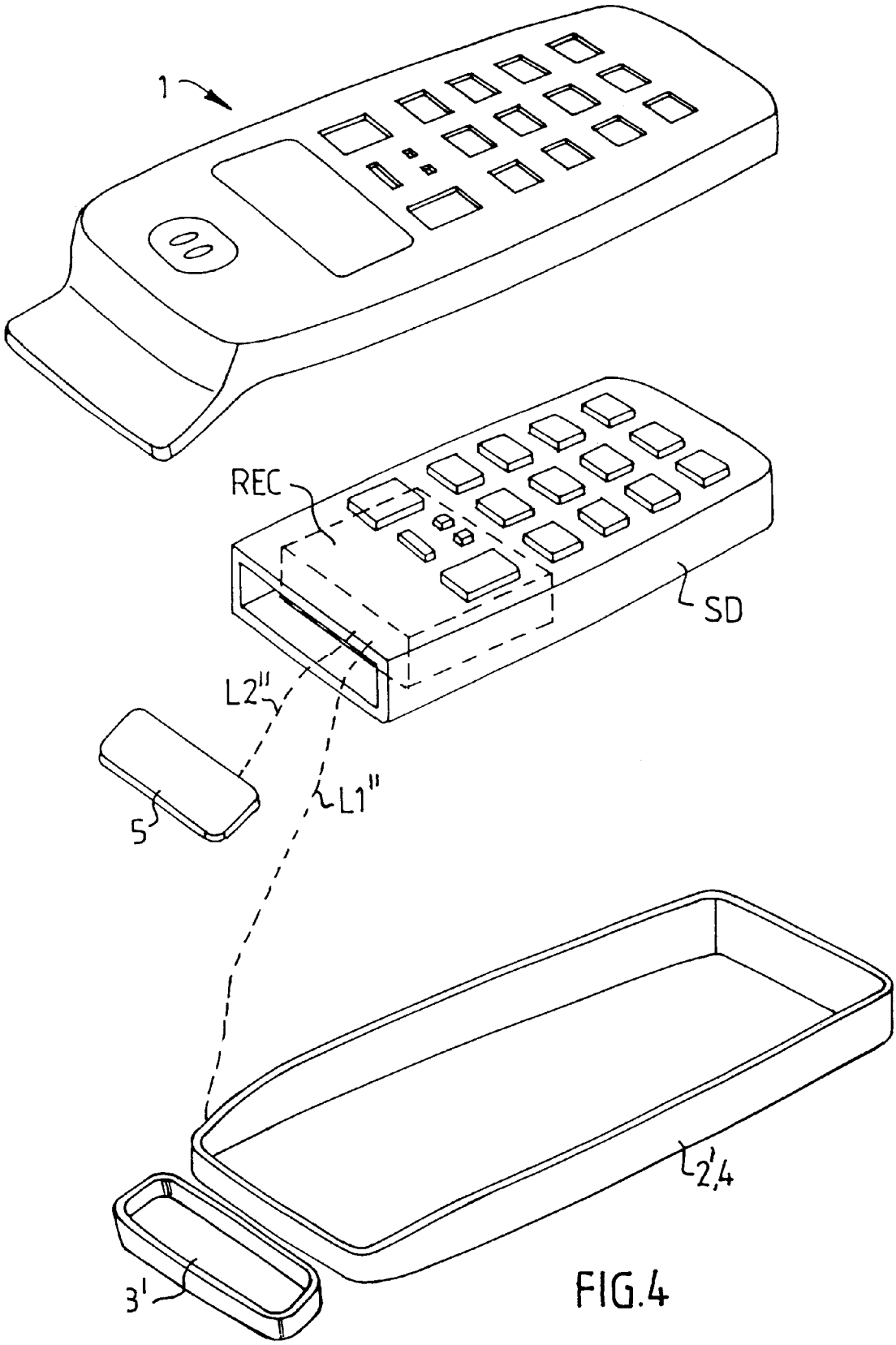
FIG. 4 shows a schematic exploded view of a mobile terminal, equipped with an antenna system according to a third embodiment of the present invention.
Figure 5:
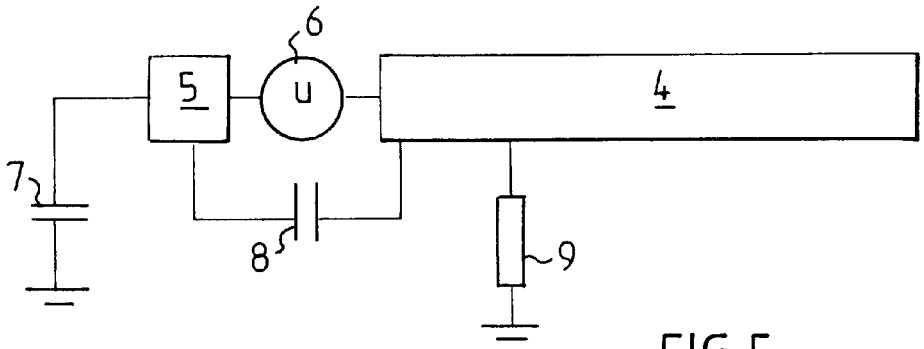
FIG. 5 shows schematically the antenna system according to the invention with electric components forming an electric equivalence to the circuit of the antenna system.

FIG. 4 shows a third embodiment of the present invention. A back portion 2' of the casing is made out of a material, suitable for an antenna. Thus, the back portion 2' of the casing serves as the end-fed antenna. As an alternative the whole casing, or the front portion thereof, could serve as the end-fed antenna. A separate cover 3', in a non-conductive material, is adapted to carry the counterpoise element 5. In this embodiment the chassis could constitute a separate part, or, as an alternative, the casing, or a part thereof, e.g. the back portion 2' thereof, could also serve as a chassis for the mobile terminal 1. Thus, the mobile terminal 1 could be provided with a body, having multiple tasks of a structural chassis, a casing, and an end-fed antenna. In FIG. 4, the connection from the radio electronic circuits REC to the back portion 2' of the casing and the counterpoise 5 is represented by the broken lines L1" and L2", respectively FIG. 5 shows schematically the antenna system according to the invention with electric components forming an electric equivalence to the circuit of the antenna system. The antenna is fed by a power source 6, for example a transmitter. The counterpoise element 5, being much smaller than the end-fed antenna 4, and located at a distance from the end-fed antenna 4, the distance being in the order of the size of the counterpoise element 5, has a self-capacitance 7 and a shunt-capacitance 8 to the end-fed antenna 4. The end-fed antenna 4 has an impedance 9.

Figure 6:
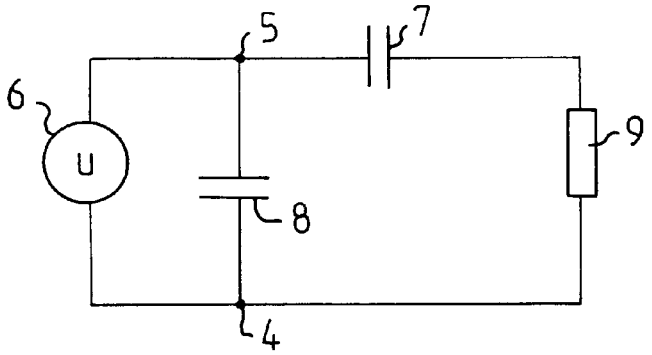
FIG. 6 shows a circuit being equivalent to the circuit in FIG. 5.

FIG. 6 shows a circuit being equivalent to the circuit in FIG. 5. The circuit in FIG. 6 shows that the impedance 9 of the end-fed antenna 4 is fed from the power source 6 in series with the self-capacitance 7 of the counterpoise element 5. The impedance 9 of the end-fed antenna 4 is also shunted by the shunt-capacitance 8 between the counterpoise element 5 and-the end-fed antenna.

The circuit in FIG. 6 indicates that, to achieve a good antenna performance, the shunt-capacitance 8 should be small in relation to the self-capacitance 7. If the electrical length of the end-fed antenna is in the vicinity of a full or half wavelength of frequencies used, the impedance of the end-fed antenna is higher than it would be at quarter wave resonances. This means that the self-capacitance 7 can be smaller at full or half wave resonances, than at quarter wave resonances.

The counterpoise element 5 is small in relation to the wavelength of frequencies to be used in communications between the mobile terminal 1 and a base station. During operation, to utilize as much as possible of the self-capacitance 7 of the counterpoise element 5, as large part as possible of the latter should have as high voltage as possible. As an example, tests have shown that good results for the antenna are achieved if the counterpoise element 5 consists of a rectangular plate of a conductive material, having a length of approximately 33 mm, a width of 8 mm, and if the counterpoise element 5 is oriented with its longitudinal direction in the transverse direction of the end-fed antenna 4, and the distance between the end-fed antenna 4 and the counterpoise element 5 is 14 mm.

Figure 7:
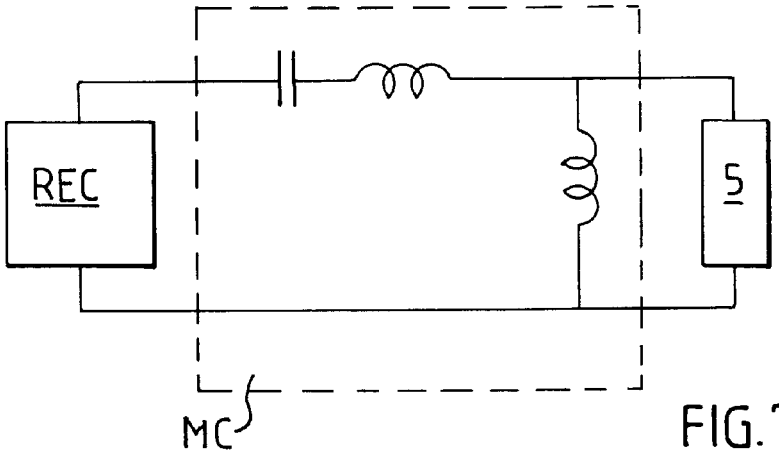
FIG. 7 shows a circuit with a matching circuit, according to a preferred embodiment of the present invention.

FIG. 7 shows a preferred arrangement for impedance matching of the antenna system. Impedance matching is accomplished by a matching circuit MC, shown within broken lines in FIG. 7. The matching circuit MC is arranged for two resonances or bands, and is connected between the radio electronic circuits REC and the counterpoise element 5. For more than two bands, additional matching circuits can be connected in parallel to the counterpoise element 5.

Figure 8:
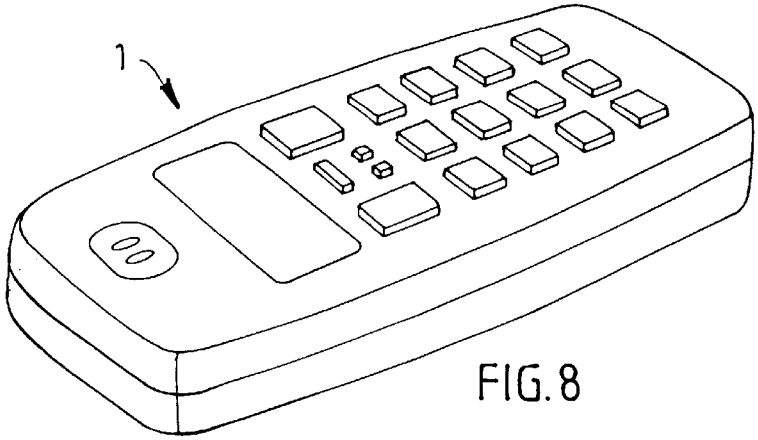
FIG. 8 shows a schematic perspective view of a mobile terminal, equipped with an antenna system according to a fourth embodiment of the present invention.
Figure 9:
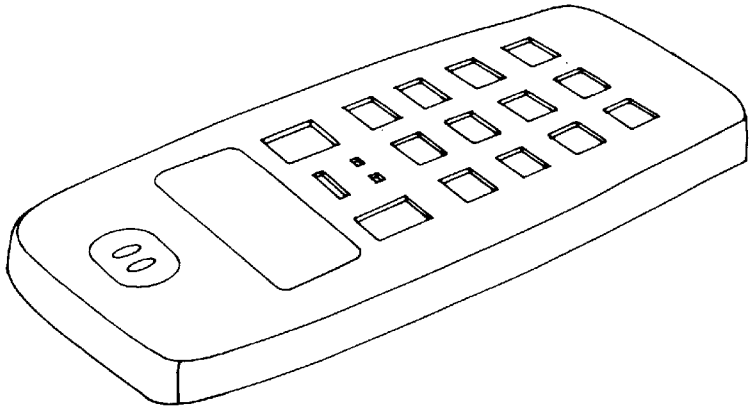
FIG. 9 shows a schematic exploded view of the mobile terminal from FIG. 8.
Figure 9:
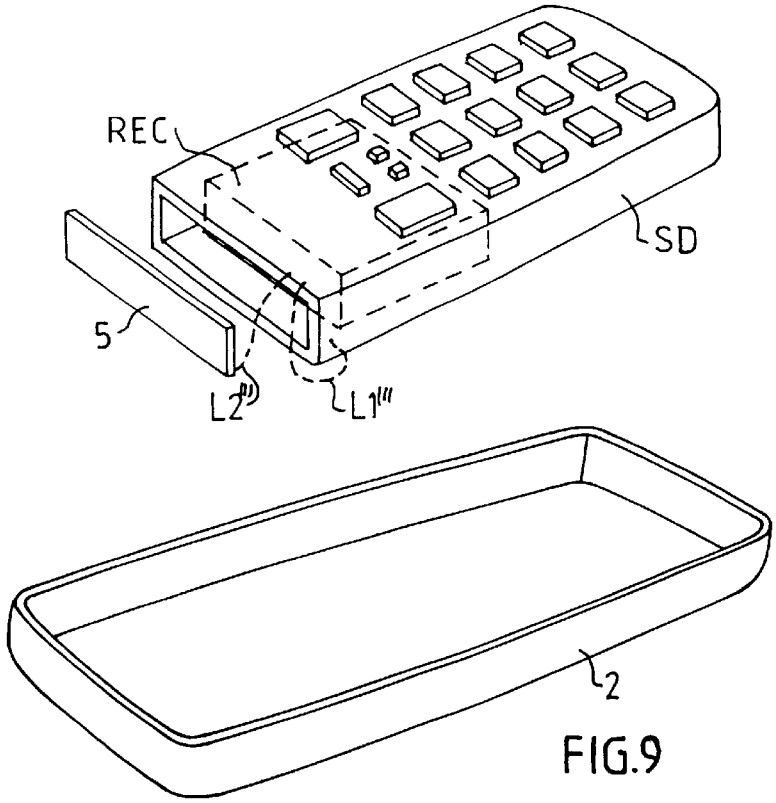

The FIGS. 8–9 depict a mobile terminal 1 equipped with an antenna system according to a fourth embodiment of the present invention. A casing 2 encloses both a counterpoise element 5 and a screening device SD for radio-electronic circuits REC. As in FIG. 3, the screening device SD serves as an end-fed antenna. In this embodiment the counterpoise element 5 is a metal strip extending in the transverse direction of the end-fed antenna. The cross section of the counterpoise element 5 is oriented transversely of the end-fed antenna. The cross section counterpoise element 5 could also be curved or form a circle.

Figure 10:
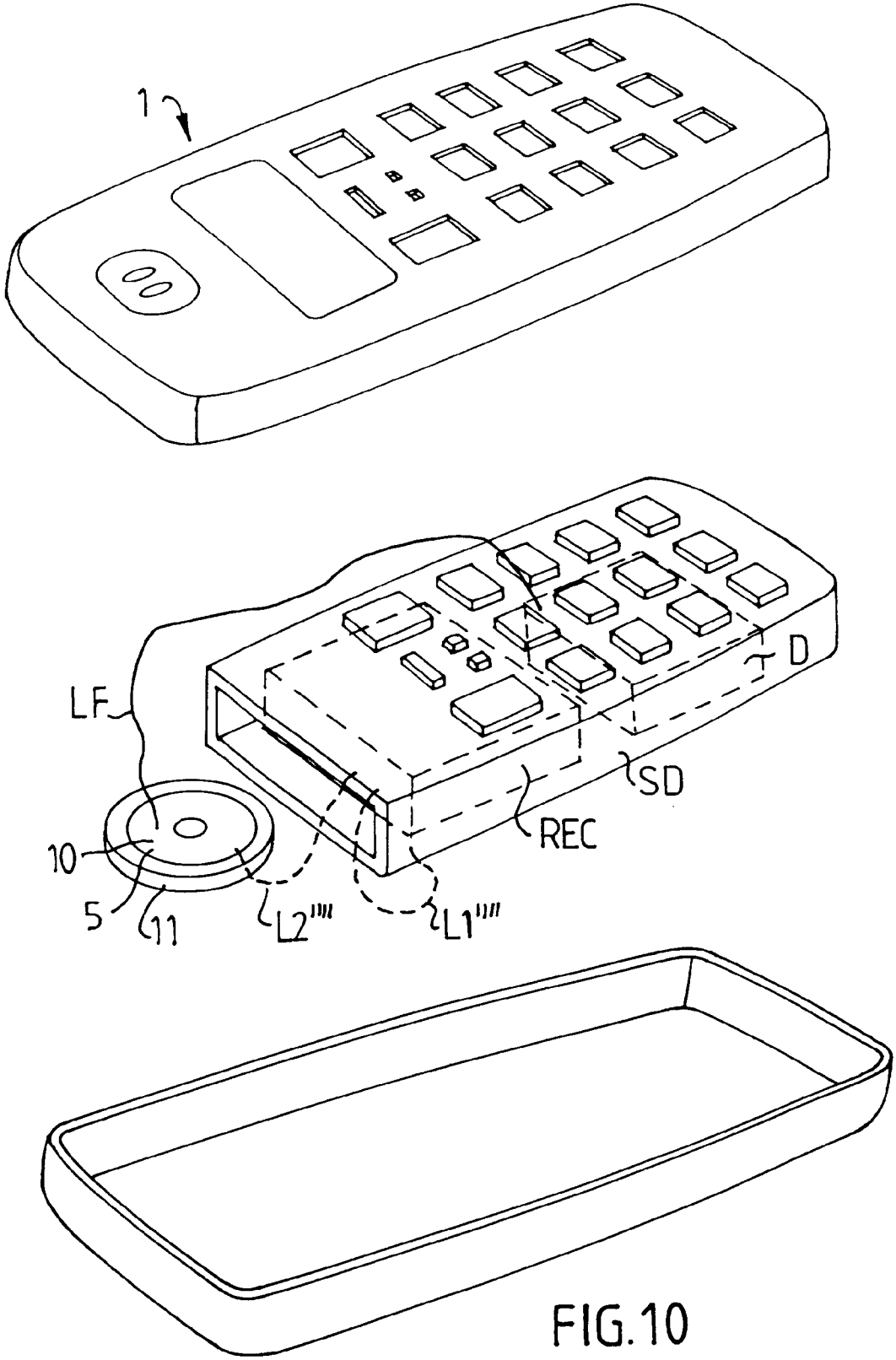
FIG. 10 shows a schematic exploded view of a mobile terminal, equipped with an antenna system according to a fifth embodiment of the present invention.

FIG. 10 illustrates an antenna system according to a fifth embodiment of the present invention. A speaker 10, typically installed for the transfer of sound to a user of the mobile terminal 1, is connected to a demodulator D, located within a screening device SD and illustrated with broken lines in FIG. 10. The speaker 10 and the demodulator D is connected via low frequency conduits LF, in a manner known in the art. As in FIG. 3, the screening device SD serves as an end-fed antenna. The speaker 10 is located at one end of the screening device SD, and is, as is typical in the art, made in a conductive material. In this embodiment the speaker 10 forms a counterpoise element 5 for the antenna system. As an alternative a frame 11, made out of conductive material and surrounding the speaker 10 is utilized as a counterpoise element 5, together with the speaker 10. The speaker 10 is connected to radio electronic circuits REC, as is illustrated by the broken line L2"". Combining a counterpoise function and a speaker function in one unit provides for a better utilization of volume available in the mobile terminal.

Figure 11:
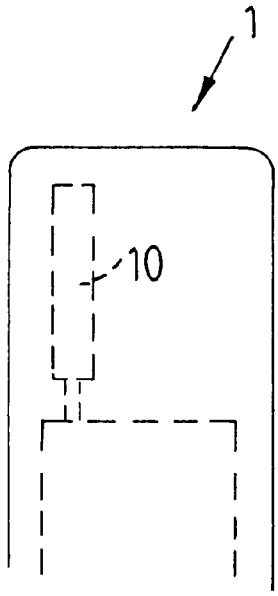
FIG. 11 shows a side view of the upper part of the mobile terminal from FIG. 10.
Figure 12:
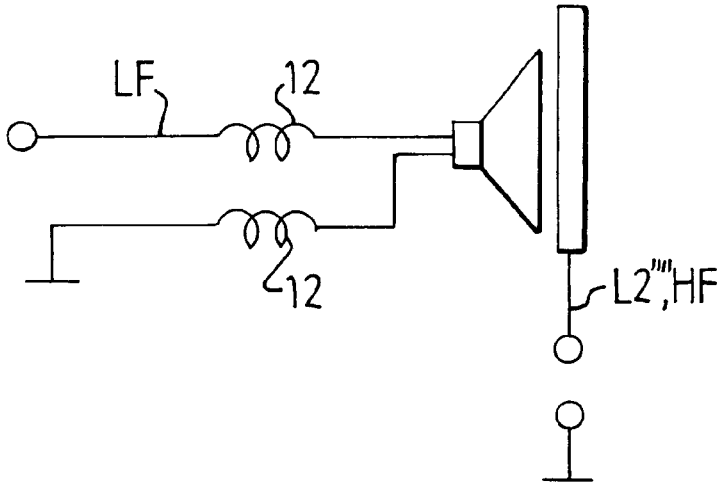
FIG. 12 shows schematically part of the antenna system and a speaker in the mobile terminal from FIG. 10.

Referring to FIG. 11, to decrease a user'exposure to radiation from the antenna system, the speaker 10 is placed close to the backside of the mobile terminal 1. As is shown in FIG. 12, to avoid high frequency signals HF in the low frequency conduits LF and to avoid that the counterpoise is grounded, the low frequency conduits LF can be choked with choke coils 12.

What is claimed is:

1. An antenna system for a mobile terminal, comprising:

a casing, which accommodates radio electronic circuits and a screening device for the radio electronic circuits;

an end-fed antenna, having an extended shape and being connected to the radio electronic circuits; and a counterpoise element, located near one end of the end-fed antenna, wherein:

the end-fed antenna is adapted to be fed, during transmission, against the counterpoise element by the radio electronic circuits, and wherein the end-fed antenna is located within and extends through a major part of the casing.

2. An antenna system according to claim 1, wherein the electrical length of the end-fed antenna is approximately a multiple of a half wavelength.

3. An antenna system according to claim 2, wherein the electrical length of the end-fed antenna approximately corresponds to a full and a half wavelength of two respective frequencies, on which the end-fed antenna is intended to transmit or receive.

4. An antenna system according to claim 1, wherein the counterpoise element is smaller than the end-fed antenna, and located at a distance from the end-fed antenna.

5. An antenna system according to claim 4, wherein the distance is on the order of the size of the counterpoise element.

6. An antenna system according to claim 1, wherein the counterpoise element is small in relation to the wavelength of frequencies to be used in communications between the mobile terminal and a base station.

7. An antenna system according to claim 1, wherein the counterpose element is extended in a direction transverse to the longitudinal direction of the end-fed antenna.

8. An antenna system according to claim 1, wherein at least two impedance matching networks form a multi-port filter, adapted to allow simultaneous use of the antenna system for two or more frequency bands.

9. An antenna system according to claim 8, wherein the impedance matching networks are connected in parallel to the counterpoise element.

10. An antenna system according to claim 8, for a mobile terminal provided with a speaker, wherein the speaker forms a counterpoise element for the antenna system.

11. An antenna system for a mobile terminal, comprising:

a casing, which accommodates radio electronic circuits and a screening device for the radio electronic circuits;

an end-fed antenna, having an extended shape and being connected to the radio electronic circuits; and a counterpoise element, located near one end of the end-fed antenna, wherein:

the end-fed antenna is adapted to be fed, during transmission, against the counterpoise element by the radio electronic circuits, and wherein the end-fed antenna forms a chassis.

12. An antenna system for a mobile terminal, comprising:

a casing, which accommodates radio electronic circuits and a screening device for the radio electronic circuits;

an end-fed antenna, having an extended shape and being connected to the radio electronic circuits; and a counterpoise element, located near one end of the end-fed antenna, wherein:

the end-fed antenna is adapted to be fed, during transmission, against the counterpoise element by the radio electronic circuits, and wherein the screening device forms the end-fed antenna.

13. An antenna system for a mobile terminal, comprising:

a casing, which accommodates radio electronic circuits and a screening device for the radio electronic circuits;

an end-fed antenna, having an extended shape and being connected to the radio electronic circuits; and a counterpoise element, located near one end of the end-fed antenna, wherein:

the end-fed antenna is adapted to be fed, during transmission, against the counterpoise element by the radio electronic circuits, and wherein the end-fed antenna forms a chassis, and the screening device.

14. An antenna system for a mobile terminal, comprising:

a casing, which accommodates radio electronic circuits and a screening device for the radio electronic circuits;

an end-fed antenna, having an extended shape and being connected to the radio electronic circuits; and a counterpoise element, located near one end of the end-fed antenna, wherein:

the end-fed antenna is adapted to be fed, during transmission, against the counterpoise element by the radio electronic circuits, and wherein the end-fed antenna forms a casing, or a part thereof, for the mobile terminal.

15. An antenna system for a mobile terminal, comprising:

a casing, which accommodates radio electronic circuits and a screening device for the radio electronic circuits;

an end-fed antenna, having an extended shape and being connected to the radio electronic circuits; and a counterpoise element, located near one end of the end-fed antenna, wherein:

the end-fed antenna is adapted to be fed, during transmission, against the counterpoise element by the radio electronic circuits, and wherein the end-fed antenna forms a casing, or a part thereof, for the mobile terminal, and a chassis for the mobile terminal.

16. An antenna system for a mobile terminal, comprising:

a casing, which accommodates radio electronic circuits and a screening device for the radio electronic circuits;

an end-fed antenna, having an extended shape and being connected to the radio electronic circuits; and a counterpoise element, located near one end of the end-fed antenna, wherein:

the end-fed antenna is adapted to be fed, during transmission, against the counterpoise element by the radio electronic circuits, wherein at least two impedance matching networks form a multi-port filter, adapted to allow simultaneous use of the antenna system for two or more frequency bands, and wherein the antenna arrangement is for a mobile terminal provided with a speaker, wherein the speaker forms a counterpoise element for the antenna.

* * * * *